US009645536B2

(12) United States Patent
Amano

(10) Patent No.: US 9,645,536 B2
(45) Date of Patent: May 9, 2017

(54) FIXING DEVICE AND IMAGE FORMING APPARATUS

(71) Applicant: FUJI XEROX CO., LTD., Tokyo (JP)

(72) Inventor: Jumpei Amano, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/042,940

(22) Filed: Feb. 12, 2016

(65) Prior Publication Data

US 2017/0010572 A1 Jan. 12, 2017

(30) Foreign Application Priority Data

Jul. 7, 2015 (JP) ..... 2015-135947

(51) Int. Cl.
*G03G 15/20* (2006.01)

(52) U.S. Cl.
CPC ..... *G03G 15/2064* (2013.01)

(58) Field of Classification Search
CPC ..... G03G 15/206; G03G 15/2064; G03G 15/2053
USPC ..... 399/328–331
See application file for complete search history.

(56) References Cited

U.S. PATENT DOCUMENTS 8,583,020 B2 11/2013 Yoshikawa et al.
2014/0286684 A1* 9/2014 Takagi ..... G03G 15/2053 399/329

FOREIGN PATENT DOCUMENTS

JP 2011-197182 A 10/2011

* cited by examiner

*Primary Examiner* — Hoang Ngo
(74) *Attorney, Agent, or Firm* — Oliff PLC

(57) ABSTRACT

A fixing device includes a belt member that moves circularly and has an inner peripheral surface to which an oil is applied, a pressure member that is disposed in such a manner as to be in contact with an outer peripheral surface of the belt member and that applies pressure to a recording material on which an image has been formed, a heating member that is disposed in such a manner as to be in contact with the inner peripheral surface of the belt member and that heats the belt member, the heating member having an upstream side end portion that is located on an upstream side in a rotation direction of the belt member and separated from the inner peripheral surface.

10 Claims, 4 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2015-135947 filed Jul. 7, 2015.

BACKGROUND

Technical Field

The present invention relates to a fixing device and an image forming apparatus.

SUMMARY

According to an aspect of the invention, there is provided a fixing device including a belt member that moves circularly and has an inner peripheral surface to which an oil is applied, a pressure member that is disposed in such a manner as to be in contact with an outer peripheral surface of the belt member and that applies pressure to a recording material on which an image has been formed, a heating member that is disposed in such a manner as to be in contact with the inner peripheral surface of the belt member and that heats the belt member, the heating member having an upstream side end portion that is located on an upstream side in a rotation direction of the belt member and separated from the inner peripheral surface.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail below with reference to the accompanying drawings.

Figure 1:
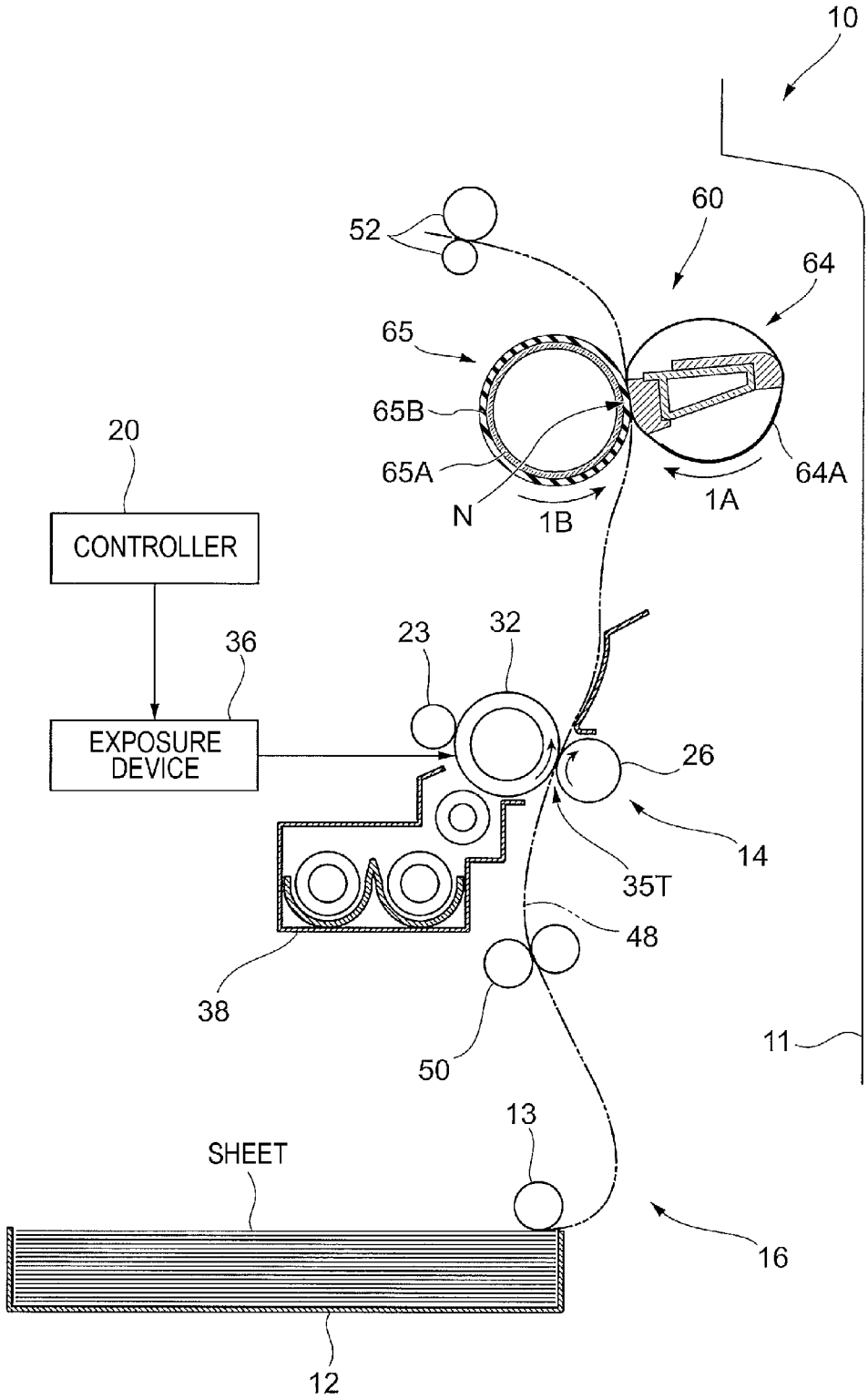
FIG. 1 is a diagram illustrating a configuration of an image forming apparatus.

FIG. 1 is a diagram illustrating the configuration of an image forming apparatus 10 according to the present exemplary embodiment.

The image forming apparatus 10 is provided with a housing 11. A container 12 in which sheets, each of which is an example of a recording material, are accommodated and an image forming unit 14, which is an example of an image forming unit that performs image formation on the sheets, are disposed in the housing 11.

In addition, a sheet-transport mechanism 16 that transports the sheets from the container 12 to the image forming unit 14 and a controller 20 that controls the operation of each unit of the image forming apparatus 10 are disposed in the housing 11.

A sheet-stacking unit (not illustrated) is disposed in an upper portion of the housing 11. The sheets on each of which an image has been formed are to be stacked in the sheet-stacking unit.

The image forming unit 14 includes a photoconductor drum 32 that rotates in a counterclockwise direction in FIG. 1. The image forming unit 14 further includes a transfer roller 26 that rotates in a clockwise direction in FIG. 1 and that transfers a toner image, which is held by the photoconductor drum 32, onto one of the sheets. Note that the image forming apparatus 10 that includes one photoconductor drum 32 will be described as an example in the present exemplary embodiment. However, the image forming apparatus 10 may be a tandem type image forming apparatus that includes plural photoconductor drums 32.

A charging roller 23 that charges the photoconductor drum 32 is disposed in the vicinity of the photoconductor drum 32. In addition, an exposure device 36 that exposes the photoconductor drum 32 to light on the basis of image data from the controller 20 and forms an electrostatic latent image on the photoconductor drum 32 is disposed in the vicinity of the photoconductor drum 32.

Furthermore, a developing device 38 that develops an electrostatic latent image that is formed by the exposure device 36 and forms a toner image on the photoconductor drum 32 is disposed in the vicinity of the photoconductor drum 32.

The sheet-transport mechanism 16 includes a sheet path 48 that is a path along which the sheets are to be transported. The sheet-transport mechanism 16 further includes pairs of transport rollers 50 that are arranged beside the sheet path 48 and that transport the sheets. Note that, although only one pair of transport rollers 50 is illustrated in FIG. 1, there are plural pairs of transport rollers 50.

In FIG. 1, a fixing device 60 is disposed above a transfer portion 35T, which is formed by the photoconductor drum 32 and the transfer roller 26, that is, the fixing device 60 is disposed further downstream than the transfer portion 35T in a transport direction of the sheets. The fixing device 60 fixes a toner image that has been transferred to one of the sheets onto the sheet.

In FIG. 1, transport rollers 52 that transport one of the sheets on which a toner image has been fixed to the sheet-stacking unit (not illustrated) are disposed above the fixing device 60.

In the image forming apparatus 10 according to the present exemplary embodiment, first, one of the sheets that are accommodated in the container 12, the sheet being at the top of the sheets, is delivered to the sheet path 48 by a delivery roller 13.

Next, the sheet is transported to the transfer portion 35T by the pairs of transport rollers 50, which are disposed on the sheet path 48.

In the image forming unit 14, the charging roller 23 charges the photoconductor drum 32, and the exposure device 36 exposes the photoconductor drum 32 to light such that an electrostatic latent image is formed on the photoconductor drum 32. Then, the electrostatic latent image is developed by the developing device 38, and a toner image is formed on the photoconductor drum 32.

Subsequently, in the transfer portion 35T, the toner image is transferred onto the sheet by the transfer roller 26. After that, the sheet is transported to the fixing device 60, and a heat treatment and a pressure treatment are performed on the sheet in the fixing device 60. The sheet that has passed through the fixing device 60 is stacked in the sheet-stacking unit (not illustrated).

The configuration of the fixing device 60 will now be described.

As illustrated in FIG. 1, the fixing device 60 according to the present exemplary embodiment includes a fixing-belt module 64 that is used for fixing a toner image onto one of the sheets.

The fixing-belt module 64 includes a belt member 64A that is formed in an annular shape or a substantially annular shape (an endless loop shape). The belt member 64A rotates in the direction of arrow 1A in FIG. 1 and moves circularly. In the present exemplary embodiment, an oil is applied to an inner peripheral surface 64N of the belt member 64A, so that sliding friction generated between the belt member 64A and a member that is in contact with the inner peripheral surface 64N of the belt member 64A will be reduced.

The fixing device 60 further includes a pressure roller 65, which is an example of a pressure member.

The pressure roller 65 is pressed against an outer peripheral surface of the belt member 64A, which is included in the fixing-belt module 64, and applies pressure to one of the sheets on which an image has been formed.

The pressure roller 65 includes a cylinder member 65A that is made of a metal material or the like. In addition, an elastic layer 65B is disposed over the outer periphery of the cylinder member 65A.

In the present exemplary embodiment, one of the sheets is fed to a nip part N that is a part in which the fixing-belt module 64 and the pressure roller 65 are in contact with each other, and the sheet is pressed by the fixing-belt module 64 and the pressure roller 65 in the nip part N. As a result, a toner image formed on the sheet is pressurized and heated so as to be fixed onto the sheet.

Note that, in the present exemplary embodiment, a motor (not illustrated) causes the pressure roller 65 to rotate in the direction of arrow 1B, and the belt member 64A of the fixing-belt module 64 is driven by the pressure roller 65 and rotates in the direction of arrow 1A.

Figure 2:
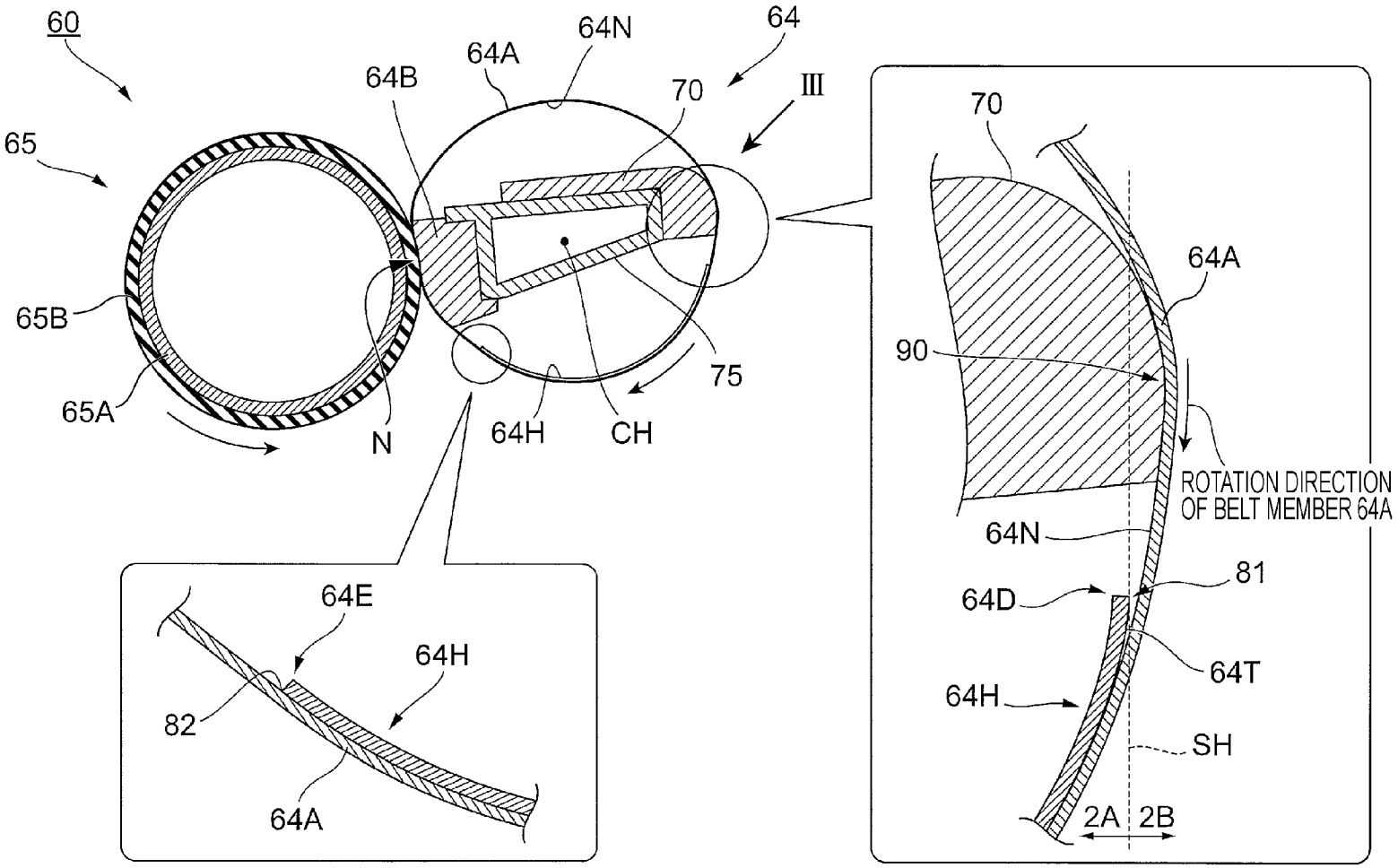
FIG. 2 is an enlarged view of a fixing device.

FIG. 2 is an enlarged view of the fixing device 60.

As described above, the fixing device 60 includes the fixing-belt module 64, which includes the belt member 64A, and the pressure roller 65, which is pressed against the fixing-belt module 64.

The fixing-belt module 64 includes a pressure pad 64B that is disposed in a space enclosed by the belt member 64A and that presses the pressure roller 65 via the belt member 64A. In the present exemplary embodiment, the nip part N is defined between the pressure pad 64B and the pressure roller 65.

A heating member 64H that is in contact with the inner peripheral surface 64N of the belt member 64A and that heats the belt member 64A is disposed in the space enclosed by the belt member 64A.

The heating member 64H is formed of a sheet-shaped heater. The heating member 64H is arranged in such a manner as to follow the shape of the inner peripheral surface 64N of the belt member 64A and has an upstream side end portion 64D and a downstream side end portion 64E.

The upstream side end portion 64D is located on an upstream side in the direction in which the belt member 64A rotates. The downstream side end portion 64E is located on a downstream side in the rotation direction of the belt member 64A.

In the present exemplary embodiment, the heating member 64H is disposed at a position different from that at which the nip part N is defined.

In a configuration in which the heating member 64H is disposed in the nip part N, a large load generated in the nip part N acts on the heating member 64H, and thus, it is necessary to increase the rigidity of the heating member 64H. In this case, the heat capacity of the heating member 64H is increased, and accordingly, the warm-up time of the fixing device 60 increases.

In the present exemplary embodiment, a pressing member 70 that presses the inner peripheral surface 64N of the belt member 64A is disposed further upstream than the upstream side end portion 64D in the rotation direction of the belt member 64A.

The pressing member 70 is disposed in the space enclosed by the belt member 64A at a position on the side opposite to the side on which the pressure pad 64B is disposed. In addition, a support frame 75 that supports the pressure pad 64B and the pressing member 70 is disposed between the pressure pad 64B and the pressing member 70.

In the present exemplary embodiment, the inner peripheral surface 64N of the belt member 64A is pressed by the pressing member 70, so that the inner peripheral surface 64N is separated from the upstream side end portion 64D of the heating member 64H. As a result, in the present exemplary embodiment, the upstream side end portion 64D is separated from the inner peripheral surface 64N of the belt member 64A.

This separation reduces the probability of the oil, which applied to the inner peripheral surface 64N, being scraped off by the upstream side end portion 64D, and the oil may enter the space between the inner peripheral surface 64N and the heating member 64H.

Here, in the case where the upstream side end portion 64D is in contact with the inner peripheral surface 64N, oil flow is likely to be interrupted by the upstream side end portion 64D, and it becomes difficult for the oil to enter the space between the heating member 64H and the inner peripheral surface 64N. In this case, it also becomes difficult for the oil to reach a portion in which the pressure pad 64B and the inner peripheral surface 64N are in contact with each other.

As a result, in this case, wearing away of the belt member 64A, the heating member 64H, the pressure pad 64B, and the like will be accelerated. In addition, in this case, it also becomes difficult for the belt member 64A to rotate. Accordingly, a failure during transportation of the sheets is likely to occur, and wrinkles are likely to be generated in the sheets.

In the present exemplary embodiment, as illustrated in FIG. 2, the heating member 64H has a facing surface 64T that faces the inner peripheral surface 64N of the belt member 64A.

The facing surface 64T is formed in such a manner as to have a curvature and to follow the shape of the inner peripheral surface 64N of the belt member 64A. As an additional point, the facing surface 64T is formed in such a manner as to have a curvature and to curve toward the inner peripheral surface 64N of the belt member 64A. In addition, the facing surface 64T is formed in such a manner as to extend in a width direction of the belt member 64A, which is a direction perpendicular to a direction of movement of the belt member 64A and a direction perpendicular to the plane in FIG. 2.

In addition, the facing surface 64T has an upstream edge 81 and a downstream edge 82.

The upstream edge 81 is located on the upstream side in the rotation direction of the belt member 64A and formed in such a manner as to extend in the width direction of the belt member 64A.

The downstream edge 82 is located on the downstream side in the rotation direction of the belt member 64A and formed in such a manner as to extend in the width direction of the belt member 64A.

In the present exemplary embodiment, when assuming a contact plane SH that is in contact with the facing surface 64T and that passes through the upstream edge 81, a center of rotation CH is located in a first region that is one of two regions facing each other with the contact plane SH interposed therebetween (a region indicated by reference numeral 2A in FIG. 2). The belt member 64A rotates around the center of rotation CH.

In the present exemplary embodiment, a contact portion 90 in which the pressing member 70 and the inner peripheral surface 64N of the belt member 64A are in contact with each other is located in a second region that is the other of the above two regions (a region indicated by reference numeral 2B in FIG. 2). In the present exemplary embodiment, as a result of the contact portion 90 being located in the second region, the upstream side end portion 64D is separated from the inner peripheral surface 64N, and the oil enters the space between the upstream side end portion 64D and the inner peripheral surface 64N.

Figure 3:
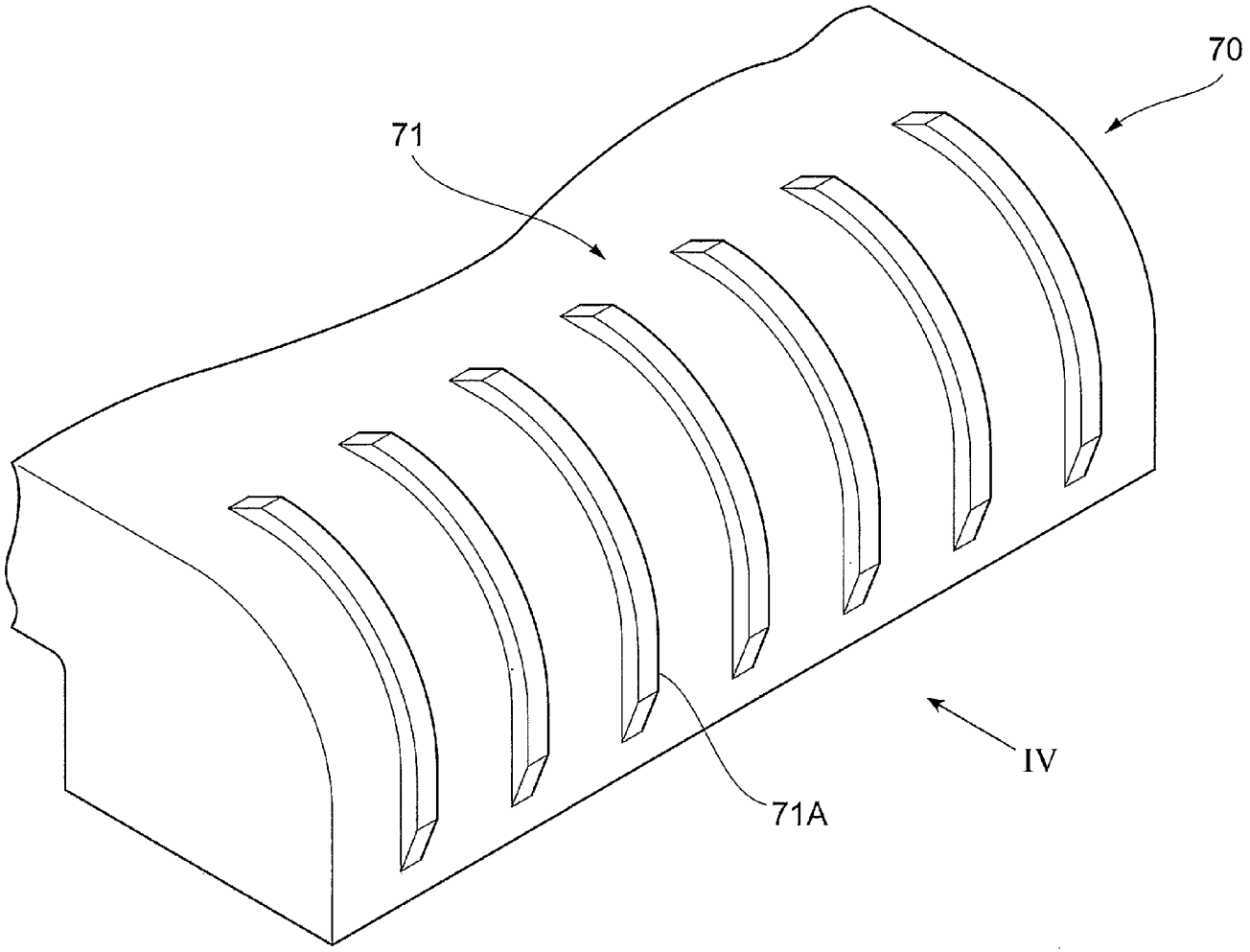
FIG. 3 is a diagram when a pressing member is viewed from the direction of arrow III in FIG. 2.

FIG. 3 is a diagram when the pressing member 70 is viewed from the direction of arrow III in FIG. 2.

As illustrated in FIG. 3, plural rib-shaped protrusions 71A, each of which functions as an oil-collecting unit, are formed on a contact portion 71 of the pressing member 70 that is in contact with the inner peripheral surface 64N. Each of the protrusions 71A is formed in such a manner as to extend in the rotation direction of the belt member 64A (see FIG. 2).

In the present exemplary embodiment, along with movement (rotation) of the belt member 64A, the oil flows from the upstream side toward the contact portion 90 (see FIG. 2), in which the pressing member 70 and the inner peripheral surface 64N are in contact with each other. Then, the oil that has reached the contact portion 90 passes between two of the protrusions 71A that are adjacent to each other and flows to a position downstream from the contact portion 90 (passes through the contact portion 90).

Note that, in the present exemplary embodiment, although the case where the protrusions 71A are formed on the contact portion 71 has been described as an example, grooves each extending in the rotation direction of the belt member 64A may be formed in the contact portion 71 and the oil may be caused to pass through the contact portion 90 by using the grooves.

Figure 4A:
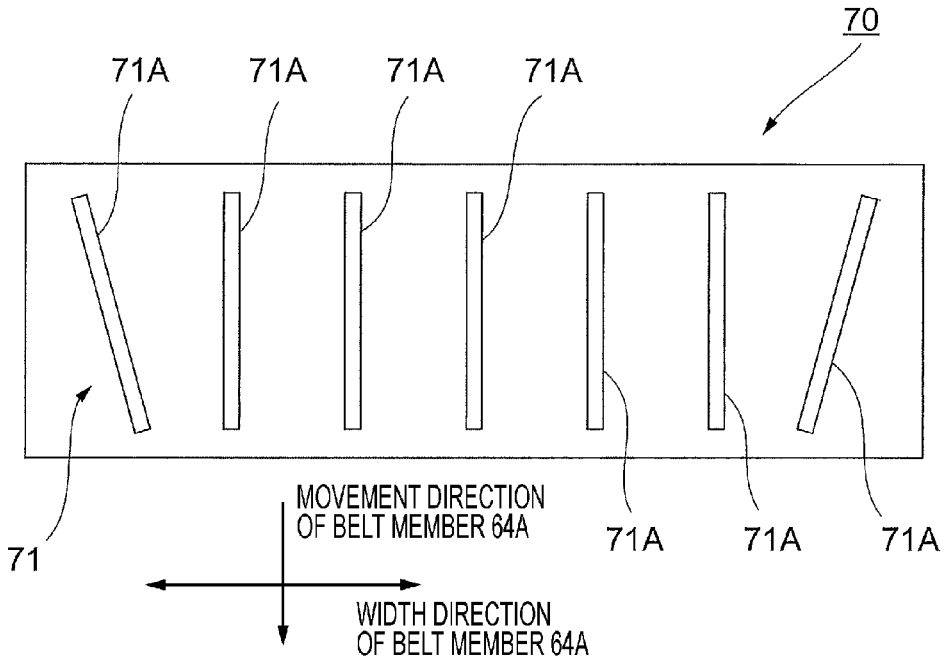
FIGS. 4A and 4B are diagrams illustrating different configuration examples of a contact portion of the pressing member.
Figure 4B:
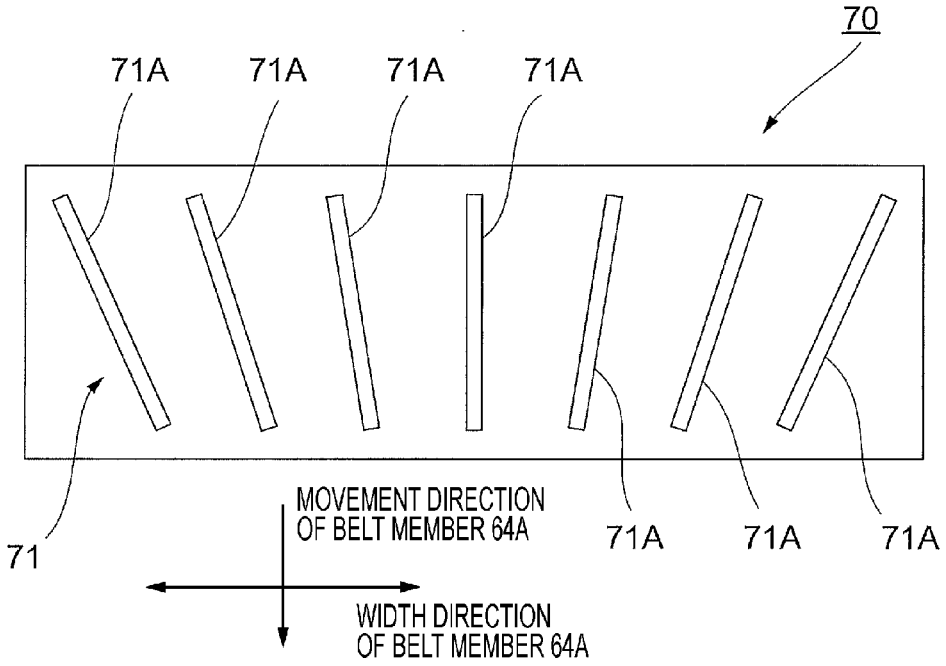

FIGS. 4A and 4B are diagrams illustrating different configuration examples of the contact portion 71 of the pressing member 70. Note that, FIGS. 4A and 4B each illustrate the state of the contact portion 71 as viewed from the direction of arrow IV in FIG. 3.

As illustrated in FIG. 4A, two of the plural protrusions 71A positioned at the opposite ends in the width direction (width direction of the belt member 64A) are inclined with respect to the direction of movement of the belt member 64A.

More specifically, in FIG. 4A, the leftmost protrusion 71A is inclined in such a manner that the distance between the leftmost protrusion 71A and a center portion of the belt member 64A in the width direction decreases toward the downstream side in the direction of movement of the belt member 64A, and the rightmost protrusion 71A is inclined in such a manner that the distance between the rightmost protrusion 71A and the center portion of the belt member 64A in the width direction decreases toward the downstream side in the direction of movement of the belt member 64A.

As a result, in the present exemplary embodiment, the oil that flows into the contact portion 71 from the upstream side along with movement of the belt member 64A flows toward the center portion of the belt member 64A in the width direction of the belt member 64A.

Note that, although the example illustrated in FIG. 4A in which only the two of the plural protrusions 71A positioned at the opposite ends in the width direction of the belt member 64A are inclined has been described above, in addition to the two protrusions 71A, the other protrusions 71A positioned between the two protrusions 71A may be inclined as illustrated in FIG. 4B. Note that, in FIG. 4B, although the inclination angles of the protrusions 71A are set in such a manner that the inclination angle of one of the protrusions 71A at a position near the center portion is smaller than that of one of the protrusions 71A at a position far from the center portion, the inclination angles of the protrusions 71A may be equal to one another.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt member that moves circularly and has an inner peripheral surface to which an oil is applied;

a pressure member that is disposed in such a manner as to be in contact with an outer peripheral surface of the belt member and that applies pressure to a recording material on which an image has been formed; and a heating member that is disposed in such a manner as to be in contact with the inner peripheral surface of the belt member and that heats the belt member, the heating member having an upstream side end portion that is located on an upstream side in a rotation direction of the belt member and separated from the inner peripheral surface and a downstream side end portion that is located on a downstream side in a rotation direction of the belt member and that is in constant contact with the inner peripheral surface of the belt member.

2. The fixing device according to claim 1, further comprising:

a pressing member that presses the inner peripheral surface of the belt member at a position further upstream than the upstream side end portion in the rotation direction of the belt member, wherein, as a result of the belt member being pressed by the pressing member, the inner peripheral surface is separated from the upstream side end portion, and the upstream side end portion is spaced away from the inner peripheral surface.

3. The fixing device according to claim 2, wherein a contact part in which the pressing member and the inner peripheral surface are in contact with each other is formed in such a manner as to be capable of causing the oil that flows to the contact part from the upstream side along with movement of the belt member to flow toward a downstream side in the rotation direction of the belt member.

4. The fixing device according to claim 3, wherein, in a contact portion of the pressing member that is in contact with the inner peripheral surface, an oil-flow control unit that causes the oil, which flows to the contact portion from the upstream side along with movement of the belt member, to flow toward a center portion of the belt member in a width direction of the belt member is disposed.

5. The fixing device according to claim 4, wherein the heating member has a facing surface that faces the inner peripheral surface of the belt member, which is formed in a substantially annular shape, and has a curvature in such a manner as to curve toward the inner peripheral surface, wherein the facing surface is formed in such a manner as to extend in the width direction of the belt member and has an upstream edge that is located on the upstream side in the rotation direction of the belt member and that extends in the width direction and a downstream edge that is located on the downstream side in the rotation direction of the belt member and that extends in the width direction, wherein a center of rotation around which the belt member rotates is located in a first region that is one of two regions facing each other with a contact plane, which is in contact with the facing surface and that passes through the upstream edge, interposed between the two regions, and wherein the contact part in which the pressing member and the inner peripheral surface are in contact with each other is located in a second region that is another one of the two regions.

6. The fixing device according to claim 3, wherein the heating member has a facing surface that faces the inner peripheral surface of the belt member, which is formed in a substantially annular shape, and has a curvature in such a manner as to curve toward the inner peripheral surface, wherein the facing surface is formed in such a manner as to extend in the width direction of the belt member and has an upstream edge that is located on the upstream side in the rotation direction of the belt member and that extends in the width direction and a downstream edge that is located on the downstream side in the rotation direction of the belt member and that extends in the width direction, wherein a center of rotation around which the belt member rotates is located in a first region that is one of two regions facing each other with a contact plane, which is in contact with the facing surface and that passes through the upstream edge, interposed between the two regions, and wherein the contact part in which the pressing member and the inner peripheral surface are in contact with each other is located in a second region that is another one of the two regions.

7. The fixing device according to claim 2, wherein, in a contact portion of the pressing member that is in contact with the inner peripheral surface, an oil-flow control unit that causes the oil, which flows to the contact portion from the upstream side along with movement of the belt member, to flow toward a center portion of the belt member in a width direction of the belt member is disposed.

8. The fixing device according to claim 7, wherein the heating member has a facing surface that faces the inner peripheral surface of the belt member, which is formed in a substantially annular shape, and has a curvature in such a manner as to curve toward the inner peripheral surface, wherein the facing surface is formed in such a manner as to extend in the width direction of the belt member and has an upstream edge that is located on the upstream side in the rotation direction of the belt member and that extends in the width direction and a downstream edge that is located on the downstream side in the rotation direction of the belt member and that extends in the width direction, wherein a center of rotation around which the belt member rotates is located in a first region that is one of two regions facing each other with a contact plane, which is in contact with the facing surface and that passes through the upstream edge, interposed between the two regions, and wherein the contact part in which the pressing member and the inner peripheral surface are in contact with each other is located in a second region that is another one of the two regions.

9. The fixing device according to claim 2, wherein the heating member has a facing surface that faces the inner peripheral surface of the belt member, which is formed in a substantially annular shape, and has a curvature in such a manner as to curve toward the inner peripheral surface, wherein the facing surface is formed in such a manner as to extend in the width direction of the belt member and has an upstream edge that is located on the upstream side in the rotation direction of the belt member and that extends in the width direction and a downstream edge that is located on the downstream side in the rotation direction of the belt member and that extends in the width direction, wherein a center of rotation around which the belt member rotates is located in a first region that is one of two regions facing each other with a contact plane, which is in contact with the facing surface and that passes through the upstream edge, interposed between the two regions, and wherein the contact part in which the pressing member and the inner peripheral surface are in contact with each other is located in a second region that is another one of the two regions.

10. An image forming apparatus comprising:

an image forming unit that performs image formation on a recording material;

a belt member that moves circularly and has an inner peripheral surface to which an oil is applied;

a pressure member that is disposed in such a manner as to be in contact with an outer peripheral surface of the belt member and that applies pressure to the recording material on which the image formation has been performed by the image forming unit; and a heating member that is disposed in such a manner as to be in contact with the inner peripheral surface of the belt member and that heats the belt member, the heating member having an upstream side end portion that is located on an upstream side in a rotation direction of the belt member and separated from the inner peripheral surface and a downstream side end portion that is located on a downstream side in a rotation direction of the belt member and that is in constant contact with the inner peripheral surface of the belt member.

* * * * *